US005928112A

United States Patent [19]

Jones et al.

[11] Patent Number: 5,928,112

[45] **Date of Patent: *Jul. 27, 1999**

[54] MACHINE FOR EXERCISING AND/OR TESTING MUSCLES OF THE HUMAN BODY

[75] Inventors: Arthur A Jones, Ocala; Philip Sencil, Anthony, both of Fla.

[73] Assignee: MedX 96, Inc., Ocala, Fla.

[ * ] Notice: This patent is subject to a terminal disclaimer.

[21] Appl. No.: 08/723,643

[22] Filed: Oct. 3, 1996

Related U.S. Application Data

[63] Continuation-in-part of application No. 07/947,284, Sep. 15, 1992, Pat. No. 5,667,463, which is a continuation-in-part of application No. 07/909,658, Jul. 7, 1992, Pat. No. 5,256,125, which is a continuation-in-part of application No. 07/813,531, Dec. 26, 1991, Pat. No. 5,149,313, which is a continuation of application No. 07/637,618, Jan. 4, 1991, Pat. No. 5,092,590, which is a division of application No. 07/422,905, Oct. 18, 1989, Pat. No. 5,005,830, which is a division of application No. 07/236,367, Aug. 25, 1988, Pat. No. 4,902,009, which is a continuation-in-part of application No. 07/060,679, Jun. 11, 1987, Pat. No. 4,836,536, and a continuation-in-part of application No. 07/181,372, Apr. 14, 1988, Pat. No. 4,834,365.

[51] Int. Cl.[6] ..... A63B 23/02

[52] U.S. Cl. ..... 482/8; 482/97; 482/100; 482/134

[58] Field of Search ..... 482/8, 9, 97, 100, 482/134, 136–138, 5, 6, 7; 73/379.01

[56] References Cited

U.S. PATENT DOCUMENTS

| | | | |
|---|---|---|---|
| 3,708,166 | 1/1973 | Annas | 482/100 |
| 3,858,873 | 1/1975 | Jones | 482/100 |
| 3,912,265 | 10/1975 | Lambert | 482/100 |
| 4,456,245 | 6/1984 | Baldwin | 482/100 |
| 4,462,252 | 7/1984 | Smidt et al. | 482/134 |
| 4,500,089 | 2/1985 | Jones | 482/100 |
| 4,711,450 | 12/1987 | McArthur | 482/5 |
| 4,807,874 | 2/1989 | Little | 482/100 |
| 4,836,536 | 6/1989 | Jones | 482/100 |
| 4,902,009 | 2/1990 | Jones | 482/100 |
| 5,256,125 | 10/1993 | Jones | 482/100 |
| 5,263,915 | 11/1993 | Habing | 482/100 |

*Primary Examiner*—John Mulcahy
*Attorney, Agent, or Firm*—William E. Mouzavires

[57] ABSTRACT

A machine for exercising and/or testing the lumbar muscles including a movement arm mounted for rotational movement about a generally horizontal axis against a resistance provided by a weight stack. Movement of the movement arm is transmitted to the weight stack by means of a transmission including a cam fixed to the movement arm, a pulley belt fixed to the periphery of the cam and trained about one or more pulleys mounted with respect to the stationary frame of the machine. The pulley belt is connected to an actuating lever connected to the weight stack pin to drive the same. One of the pulleys is mounted for movement towards and away from the pulley belt to increase or decrease tension in the pulley belt to thus control the drive between the movement arm and the weight stack.

13 Claims, 6 Drawing Sheets

MACHINE FOR EXERCISING AND/OR TESTING MUSCLES OF THE HUMAN BODY

RELATED APPLICATIONS

This application is a continuation-in-part of my prior application, Ser. No. 07/947,284, filed Sep. 15, 1992 entitled EXERCISE MACHINES AND METHODS, now U.S. Pat. No. 5,667,463, which is a continuation-in-part of my prior application, Ser. No. 07/909,658, filed Jul. 7, 1992 entitled BICEPS CURL MACHINE, now U.S. Pat. No. 5,256,125 which is a continuation-in-part of my prior application, Ser. No. 07/813,531, now U.S. Pat. No. 5,149,313 filed Dec. 26, 1991, which is a continuation of my prior application, Ser. No. 07/637,618 filed Jan. 4, 1991, now U.S. Pat. No. 5,092,590, which is a division of my prior application, Ser. No. 07/422,905, filed Oct. 18, 1989, now U.S. Pat. No. 5,005,830 which in turn is a division of my prior application, Ser. No. 07/236,367 filed Aug. 25, 1988, now U.S. Pat. No. 4,902,009, entitled MACHINE FOR EXERCISING AND/OR TESTING MUSCLES OF THE LOWER TRUNK, AND METHOD which in turn is a continuation-in-part of my prior U.S. patent applications, Ser. No. 07/060,679, filed Jun. 11, 1987, now U.S. Pat. No. 4,836,536 and Ser. No. 07/181,372, filed Apr. 14, 1988, now U.S. Pat. No. 4,834,365 and entitled COMPOUND WEIGHT SYSTEM. The disclosures of my above-identified patent applications are hereby incorporated by reference in their entirety into the instant application as part hereof.

OBJECTS OF THE PRESENT INVENTION

The present invention relates to a machine for exercising and/or testing muscles of the human body. More specifically the present invention in one preferred form relates to a machine for exercising and/or testing muscles of the lower back also known as the lumbar muscles. Although the present invention is disclosed in its preferred form in connection with a lumbar machine, it will be understood that the present invention including different aspects thereof will be applicable to machines for exercising other parts of the human body.

An object of the present invention is to provide a novel and improved machine for exercising and/or testing muscles of the human body. Included herein is a machine for exercising and/or testing the lumbar muscles of the human body, the machine being of the type disclosed in my U.S. Pat. Nos. 4,836,536; 4,834,365; and 4,902,009 identified above.

A further object of the present invention is to provide a novel and improved machine for exercising and/or testing the lumbar muscles and which will be safe, reliable and accurate and yet may be manufactured at a reduced cost without sacrificing the foregoing features.

Another object of the present invention is to provide a novel and improved exercise machine which will achieve the above objects while utilizing a weight stack to provide resistance to a movement arm which is engaged by the user and moved against resistance offered by one or more weights of the weight stack. Included herein is a provision of such a machine which incorporates a novel and improved transmission between the movement arm and the weight stack to transmit movement between the movement arm and the weight stack.

SUMMARY OF PREFERRED EMBODIMENT OF THE INVENTION

The preferred embodiment of the invention is incorporated in a machine for exercising and/or testing the lumbar muscles which of course are located in the lower back. The machine includes a movement arm mounted for rotational movement about a generally horizontal axis against the resistance offered by one or more weights of a weight stack. Movement of the movement arm is transmitted to the weight stack to raise one or more weights when the user engages the movement arm by means of a transmission including a cam fixed to the movement arm, a cam follower in the form of a pulley belt fixed to the periphery of the cam and trained about one or more pulleys mounted with respect to the stationary frame of the machine. The pulley belt is connected to an actuating lever connected to the weight stack pin to drive the same. Preferably the actuating lever is located below the weights of the weight stack and connected to a lower portion of the weight stack pin. The actuating lever is not only mounted for pivotal movement, it also is mounted to permit the actuating lever to undergo rectilinear movement towards and away from the weight stack pin to make sure that no binding occurs in the weight stack pin as the actuating lever pivots about an arc under the drive of the pulley belt. One of the pulleys is mounted for movement towards and away from the pulley belt to increase or decrease tension in the pulley belt to thus control the drive between the movement arm and the weight stack. In order to disconnect the operative drive between the movement arm and the weight stack, the adjustable pulley is moved away from the pulley belt thereby slackening the pulley belt.

In addition to dynamic exercise and testing, the machine may be placed into a mode for static strength exercise or testing in each of several different angular positions. In each position the movement arm is held against movement by means of a lock mechanism including a retaining member fixed to the movement arm and a locking member engageable with the retaining member to prevent movement of the movement arm in the desired position. The lock mechanism is releasable to allow the movement arm to move to the next angular position where it is again locked and a test is taken at that position. The lock mechanism also frees the movement arm for dynamic testing or exercise described above.

Other features of the present invention will appear below in the detailed description.

DRAWINGS

Other objects and advantages of the present invention will become apparent from the detailed description below taken in conjunction with the attached drawings in which.

DETAILED DESCRIPTION

Figure 3:
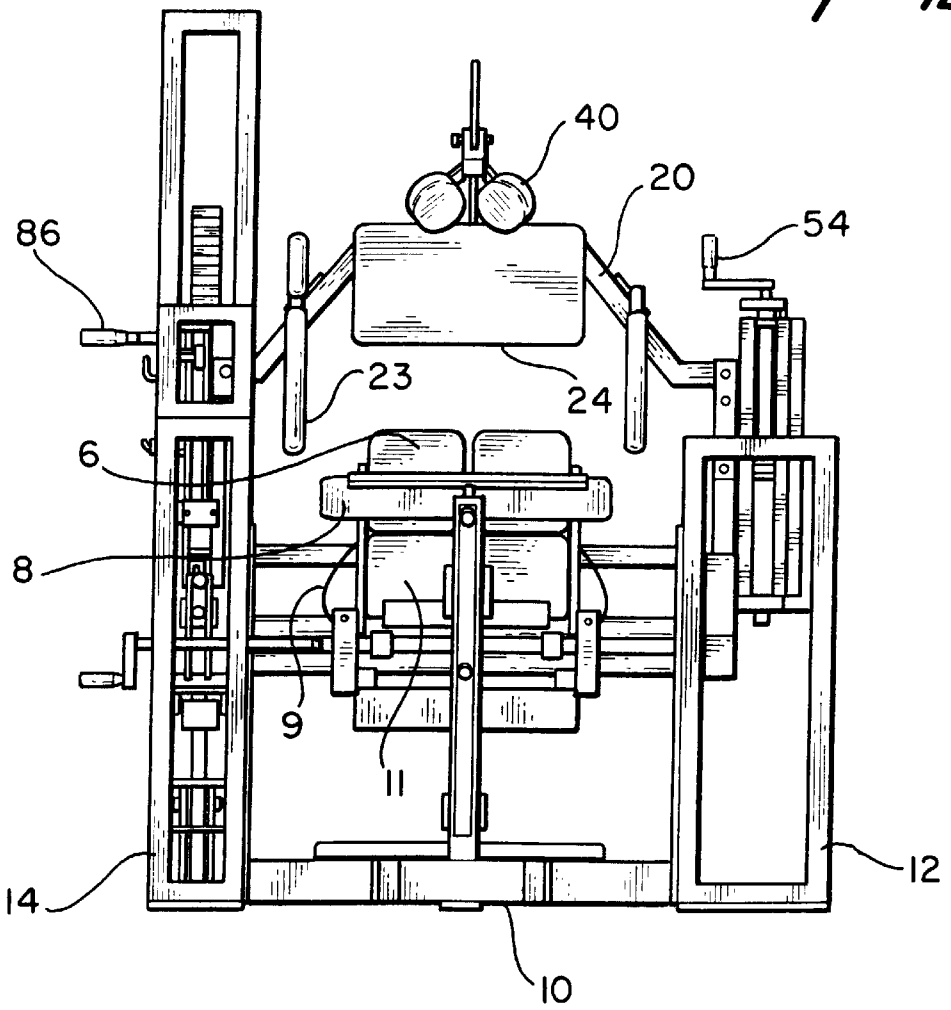
FIG. 3 is a front elevational view of the machine with certain parts removed.

Referring to the drawings in detail there is shown for illustrative purposes only a machine embodying the present invention for exercising and/or testing the lumbar muscles. The machine includes a central frame 10 fixed to side frames 12 and 14 located on opposite sides of the central frame 10 as shown in FIG. 3. Supported on the central frame 10 is a seat 11 for receiving the user with the user's feet resting on footrests 13 mounted on a frame generally designated 16 located at the front end of central frame 10. In order to isolate the lumbar muscles for exercise or testing, the legs and hips including the femurs and pelvis are immobilized as described in my U.S. Pat. Nos. 4,902,009 and 5,007,634 whose disclosures are incorporated by reference herein and may be referred to for a further description. In the shown embodiment disclosed in FIG. 3, the pelvic restraint is shown at 6, the femur and knee restraint at 8, and the seatbelt thigh restraint at 9.

Figure 2:
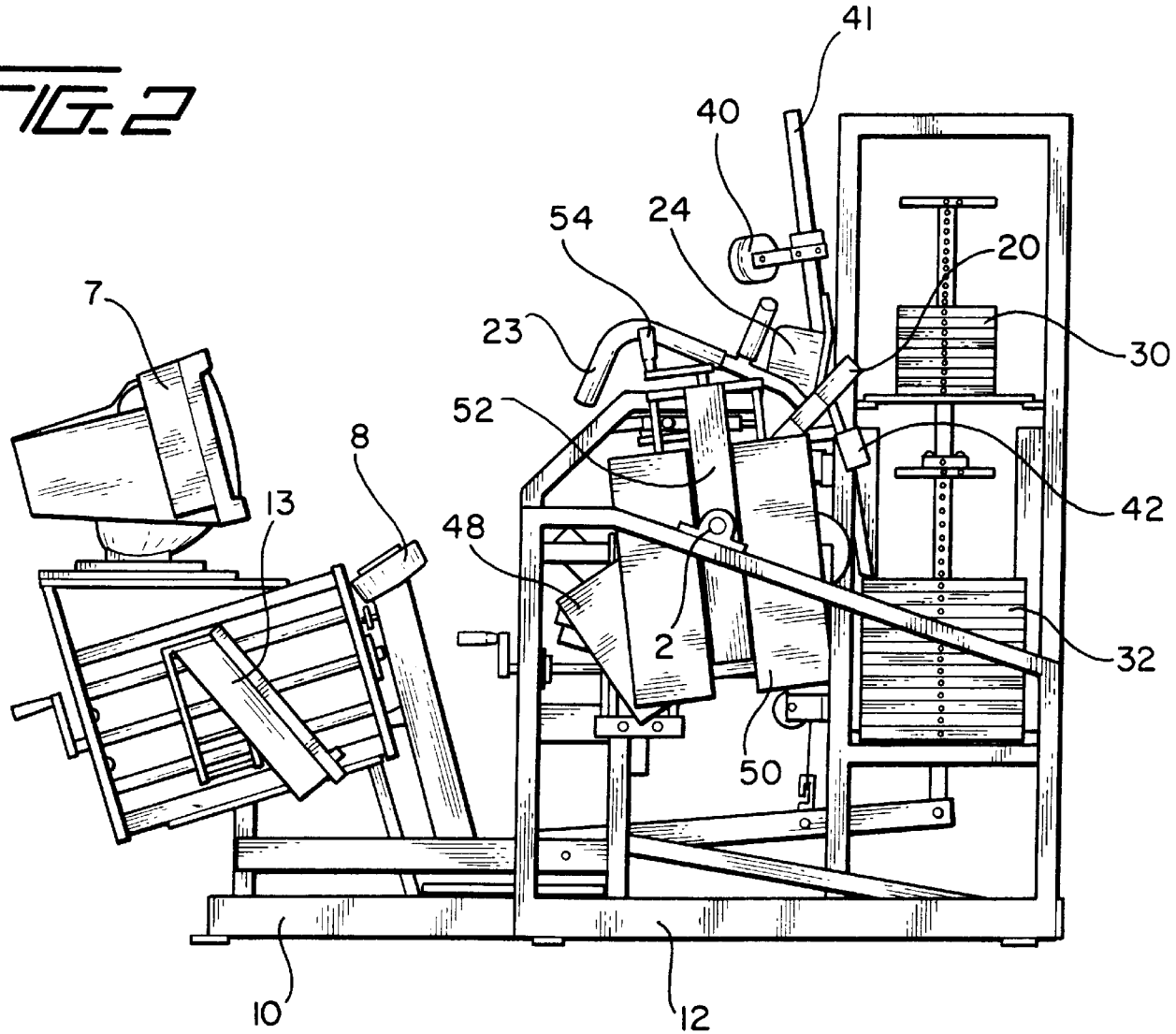
FIG. 2 is a view generally similar to FIG. 1 except taken from the opposite side of the machine.

In testing and/or exercise, the user of the machine exerts pressure against a movement arm which in the particular embodiment shown includes a generally inverted U-shape body 20 with opposite arm portions 25 having outwardly extending pivot shafts 22 fixed thereto and rotatably received in bearings 2 respectively mounted on the side frames 12 and 14, one bearing 2 shown in FIG. 2. Movement arm 20 has a back pad which may also be termed a "resistance pad" 24 engageable by the user to rotate the movement arm against a resistance load provided in the preferred embodiment by a weight stack located in frame 28. Preferably the weight stack is a compound weight stack including first and second independent weight stacks 30 and 32 as described in my patent Jones U.S. Pat. No. 4,834,265 to which reference may be had for a more detailed description. The resistance pad 24 is preferably pivotably mounted to the movement arm 20 as disclosed in my aforementioned U.S. Pat. No. 4,902,009.

During exercise or testing, the arms and head of the user are held in fixed position relative to the movement arm. This is accomplished in the shown embodiment through handlebars whose front ends are curved at 23 to be gripped by the user. The head is positioned by being placed against a headrest 40 which is adjustably mounted on a rod 41 fixed to the resistance pad 24. Headrest 40 is adjustable along the rod and then secured in the desired position. The weight of the headrest 40 and the resistance pad is balanced with respect to the pivot axis of the resistance pad by means of a counterweight 42 connected to the resistance pad and extending rearwardly as shown in FIG. 2. Indicia 43 are provided on rod 41 to indicate the position of the headrest 40.

Figure 4:
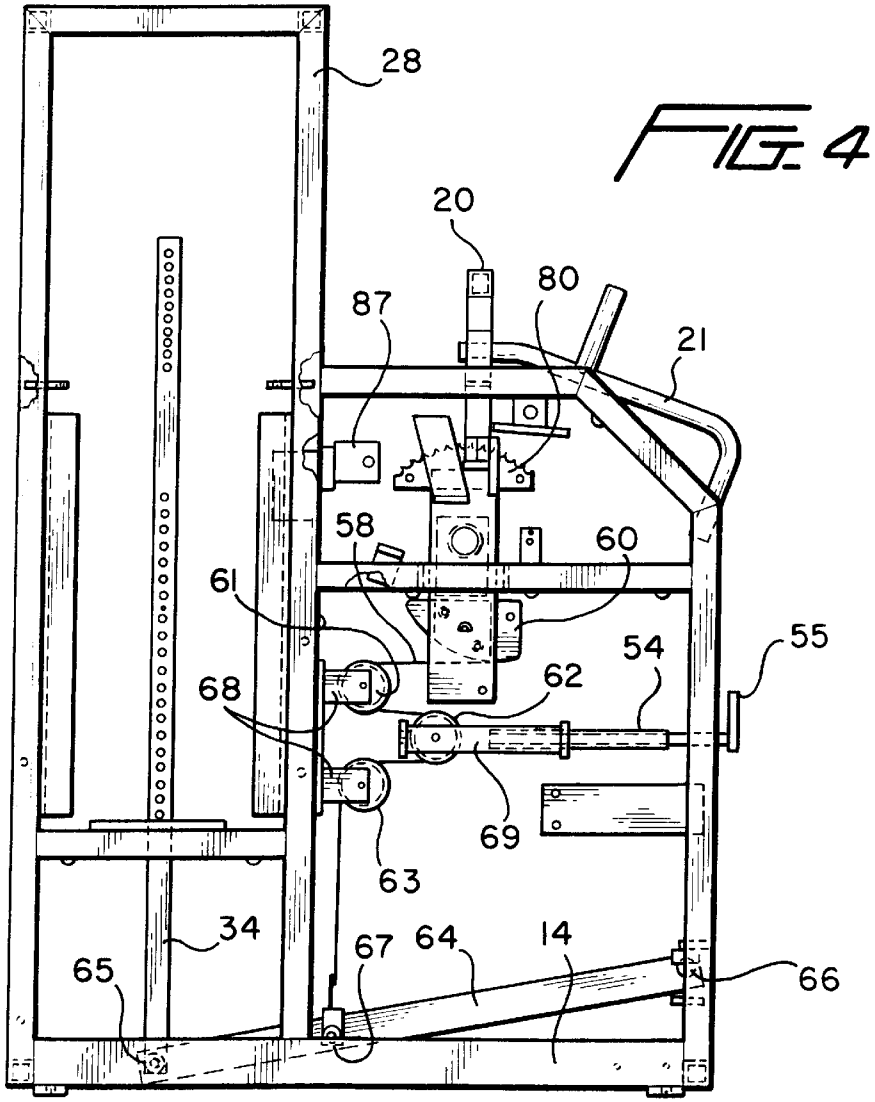
FIG. 4 is an enlarged side elevational view of the machine with parts removed to show a movement arm assembly and associated transmission included in the machine.

Movement of the movement arm 20 by the user is opposed by the weight stack which is connected to the movement arm through means of a transmission including a cam 60 fixed with respect to the movement arm and connected to an actuating lever 64 through means of one or more pulleys and a cam follower in the form of a pulley belt 58. As shown in FIG. 4, the preferred embodiment utilizes three pulleys 61, 62 and 63 about which the pulley belt 58 is trained with the lower end of the belt being connected at 67 to the actuating lever 64. The end of the pulley belt 58 is fixed to the periphery of cam 60 so that as the cam 60 rotates, the pulley belt 58 will engage along the periphery of the cam. Counterclockwise rotation as viewed in FIG. 4 of the movement arm will cause the cam to rotate counterclockwise which will have the effect of raising the belt 58 and in turn the actuating lever 64. This in turn will raise the weight stack pin 34 and any of the weights connected thereto. The rear end of actuating lever 64 is pivotally connected at 65 to the lower end of the weight stack pin 34 as shown in FIG. 4. The front end of actuating lever 64 in the shown embodiment is mounted at 66 for pivotal as well as translatory movement. This allows the actuating lever to move towards or away from the stack pin 34 when the lever 64 is rotated by the pulley belt 58 so as to compensate for the rotational arc of movement of the actuating lever 64 thereby avoiding binding of the weight stack pin 34. Any suitable means may be used to mount the end 64 of the lever with respect to the frame 14 to allow translatory motion as well as pivoting motion of the actuating lever 64. In one preferred embodiment, a passage is provided by a channel member to allow a pivot pin 66 on the forward end of the actuating lever 64 to move along the passage as it pivots. The wall of the channel member maintains the pivot 66 in the same horizontal plane while allowing it to pivot or move in translation along the horizontal plane. In another embodiment shown, for example in my U.S. Pat. No. 5,256,125, a link may be used to pivotally mount the actuating lever 64 to the frame 14 to allow the desired translatory as well as pivotal motion of the lever 64.

Pulleys 61 and 63 in the shown embodiment are mounted on brackets 68 which are fixed to the vertical members of frame 14, as shown in FIG. 4. Pivot 62, however, is mounted on a movable rod 69 having a threaded internal passage which receives an actuating screw 54 rotated by means of a hand grip 55 as best shown in FIG. 4. Rotation of screw 54 will cause the rod 69 to move along the screw 54 to allow the pulley 62 to move towards the pulley belt to engage it and increase tension or to move away from the pulley belt to decrease tension to thus control the extent of the operative connection between the movement arm and the actuating lever 64 and in turn the weight stack. This movement can be used to disconnect or control the operative connection between the movement arm and the weight stack. It can also be used to change the range of motion of the movement arm.

Figure 6:
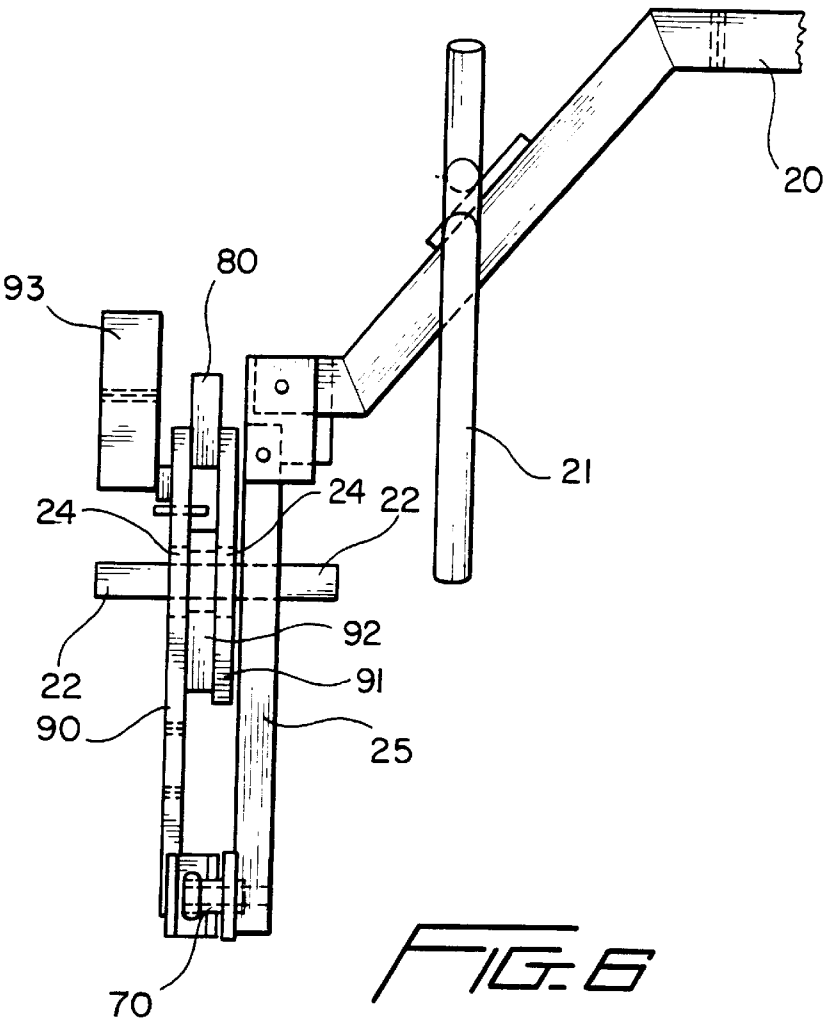
FIG. 6 is a fragmental front elevational view of the movement arm assembly as shown in FIG. 5.
Figure 5:
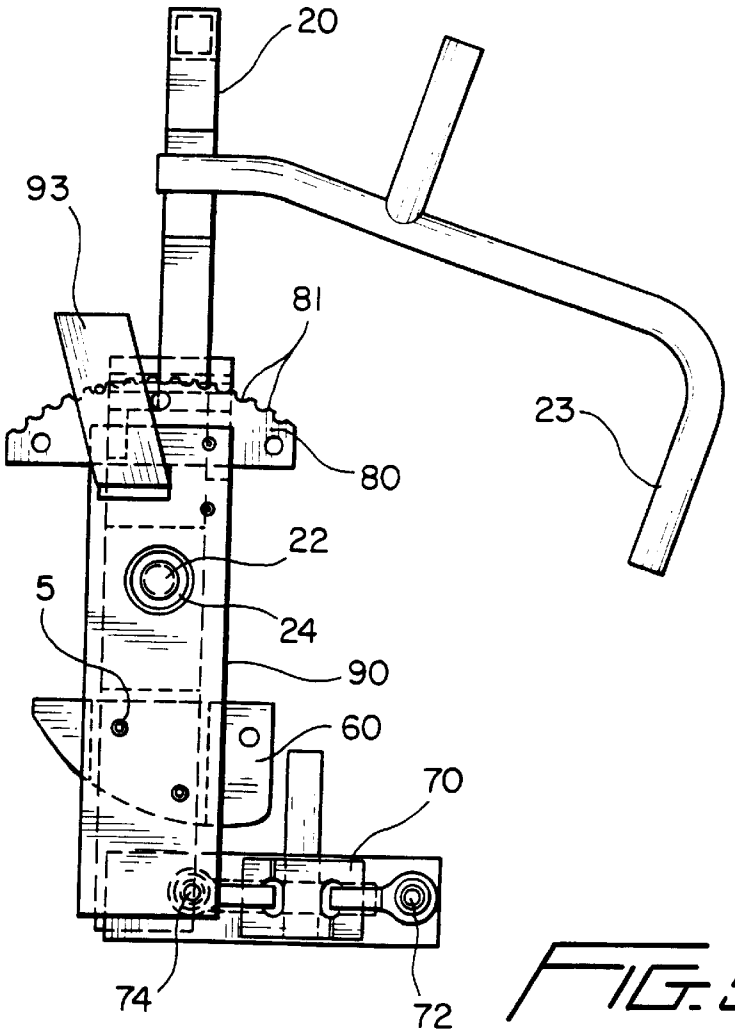
FIG. 5 is an enlarged side elevational view of a movement arm assembly included in the machine.

Referring to FIGS. 5 and 6, cam 60 is fixed with respect to the movement arm 20, 25, in the preferred embodiment shown, by means of a member 90 shown in this specific embodiment as a generally rectangular plate having an aperture receiving the shaft 22 of the movement arm with a bearing 24 located between the two parts. Cam 60 is fixed in any suitable manner such as by fasteners 5 shown in FIG. 5 to the inside surface of plate 90. Below cam 60 the lower end of plate 90 is connected to the lower end of movement arm 25 by means of a link generally designated 70 including a load cell, such as a strain gauge, for measuring forces applied to the movement arm. One end of the load cell at 72 is connected to the lower end of the movement arm 25 while the opposite end at 74 is connected to the lower end of plate 90. In the specific embodiment shown, plate 90 is fixed to plates 91 and 92 which are also located around pivot shaft 22 of the movement arm and have bearings 24 located between the pivot shaft 22 and plates 91 and 92.

Figure 1:
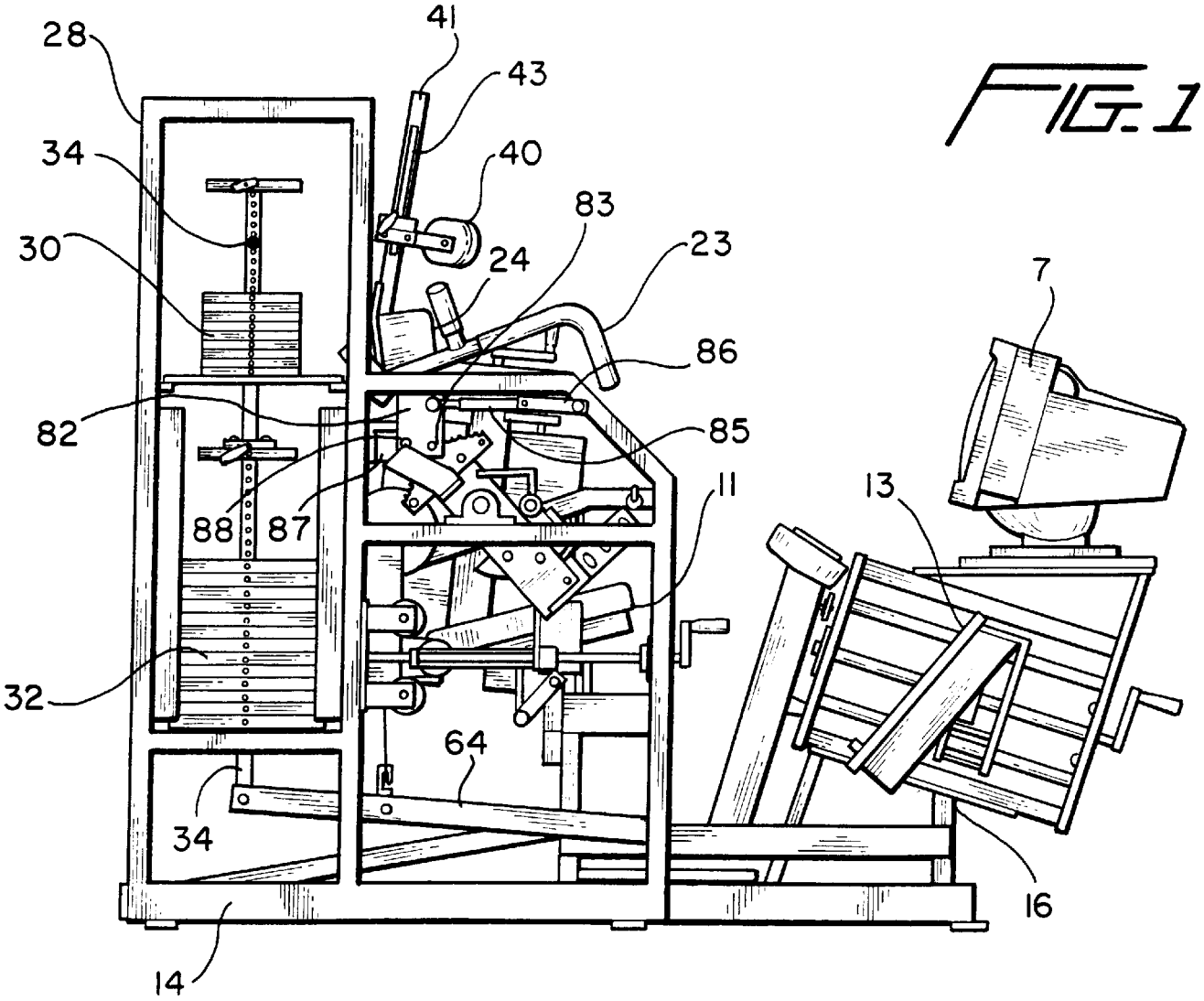
FIG. 1 is a side elevational view of a machine for exercising and/or testing the lumbar muscles.
Figure 7:
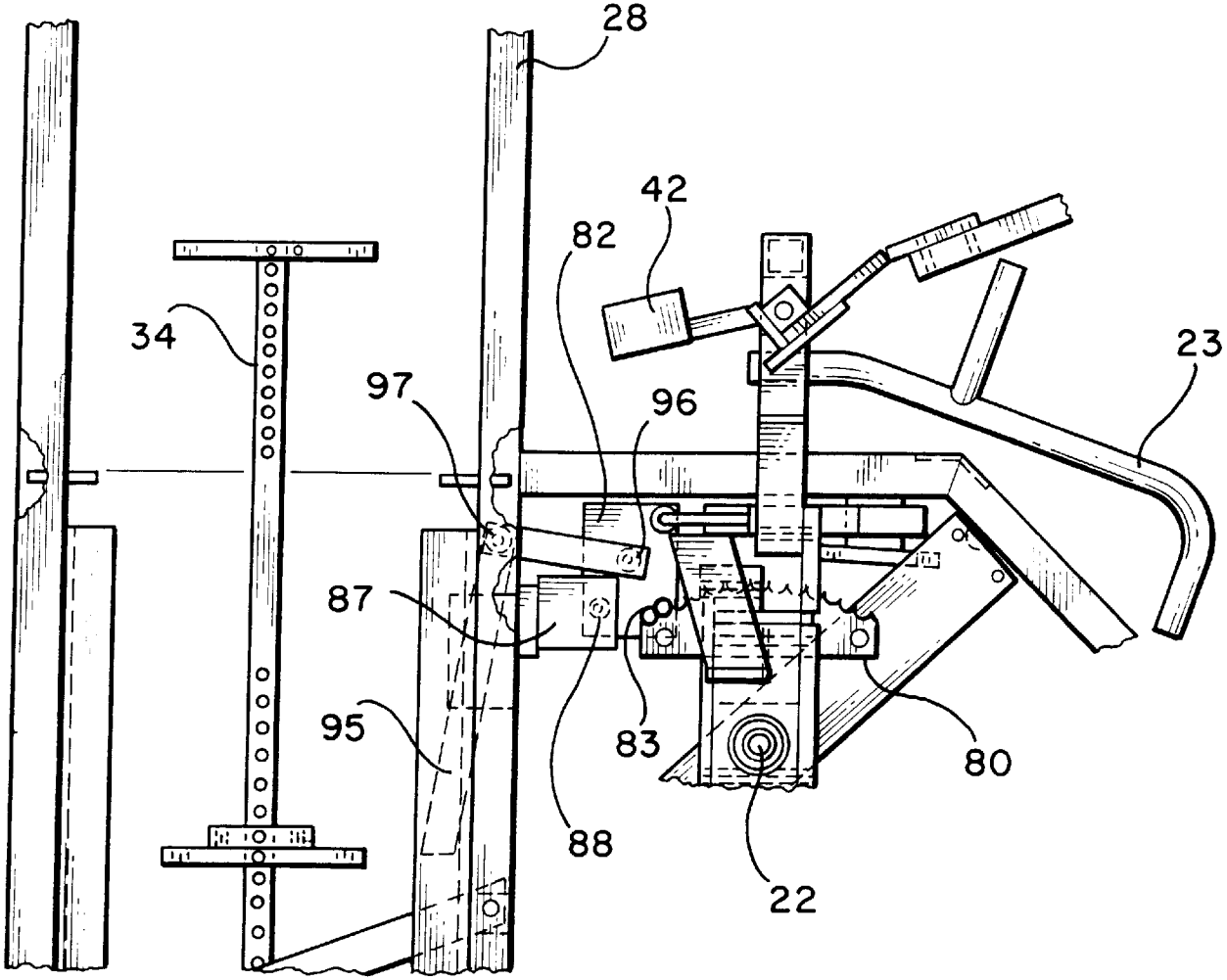
FIG. 7 is an enlarged fragmental side view of the machine illustrating a lock mechanism included therein.

In between the upper ends of plates 91 and 90 is fixed thereto a retaining member or latch plate generally designated 80 having a series of recesses 81 spaced along its upper surface at angularly spaced positions. Receivable in the recesses 81 is one or more locking pins shown at 83 in FIGS. 1 and 7 which in the specific embodiment are held between a pair of plates 82 mounted to brackets 87 fixed to the frame by pivots 88. Plates 83 are actuated to move locking pins 83 into or out of the retention notches 81 of the retaining member 80 by means of a push-pull actuator shown in the specific embodiment as including a rod 85 pivotally connected to the plates 82 and a push-pull handle 86. With reference to FIGS. 1 and 7, in order to engage locking pins 83 in the tension notches 81, the push-pull actuator 85, 86 is moved to the right or forwardly, and in order to remove the pins 83 from the notches, the push-pull actuator 85, 86 is moved rearwardly.

In order to prevent the weights 32 of the lower weight stack from moving upwardly when the lock members 82 are engaged in recesses 81 of the retaining member 80, a stop 95 is pivotably connected at 96 to plates 82 of the lock mechanism as shown in FIG. 7. Stop 95 is pivotally mounted at 97 to the frame 28 and extends downwardly to a location above the lower stack weights 32 to prevent any upward movement of the weights 32 should the pulley belt 58 be inadvertently tensioned by adjusting screw 54, 55 when the movement arm 20 is fixed by lock mechanism 82, 83. When plates 82 of the lock mechanism are pivoted counterclockwise as needed in FIG. 7 to release the lock pins 83 from the retaining member 80 of the movement arm, stop 95 will pivot counterclockwise to clear the path of the lower stack weights 32.

In order to conduct a static strength test or exercise, the movement arm 20 is fixed against its movement by actuating the lock mechanism 82,83 to insert the locking pin 83 in the desired notches of the retaining member 86 as described above. The user may then exert forces on the movement arm which will be measured by the load cell 70. A static strength test is conducted at various positions angularly spaced from each other by releasing the lock mechanism 82, 83 from the movement arm 20 and rotating the movement arm into the next test position and then re-engaging the lock mechanism to fix the movement arm and allow the static strength to be measured at the new position. The measured forces are conveyed up the load cell 80 to a computer which is connected to a monitor 7 so that a graph of the static strengths at the various positions is displayed on monitor 7 as shown in FIG. 1. Monitor 7 is mounted on the frame 16 which also holds the foot board 13. A suitable angle indicator is provided on the plate member 93 to point to a scale (not shown) on the frame 14 to indicate the angle in which the movement arm is placed during static strength testing or exercise. Plate 93 is fixed to plate 90 and serves as a counterweight to balance plates 90, 91, 92 and one half of the weight of load cell 70 with respect to the axis of pivot shaft 22.

In order to place the machine in the mode for dynamic strength testing, the lock mechanism 82, 83 is actuated to release the locking pins 83 from the retaining plate 80 thereby allowing the movement arm 20 to be pivoted about the horizontal axis of the pivot shaft 22 by the user who engages the resistance pad 24 with his/her back and moves it rearwardly against the resistance offered by the weight stack during which time the forces of positive work performed by the user are measured by a computer and recorded in graphic form on monitor 7 as the test proceeds. The user returns to the starting position during which time the user performs negative work. The exercise is then repeated. Further descriptions of the static and dynamic strength tests and methods may be found in my U.S. Pat. No. 4,902,009.

Although the invention has been shown and described in connection with exercising and/or testing the lumbar muscles, it may also be applied in machines and methods for exercising and/or testing other muscles of the human body. Therefore it should be understood that the present invention is not limited to the specific embodiment shown and described but rather covers machines and methods as defined in the appended claims.

What is claimed is:

1. A machine for exercising and/or testing muscles of the back comprising in combination: a seat for receiving a user of the machine, a movement arm for engaging a user's back and being mounted for movement about an axis, resistance means for opposing movement of the movement arm in one direction about said axis when engaged by the back, means for immobilizing the pelvis while seated on said seat during an exercise or test, and transmission means for transmitting movement between the movement arm and the resistance means, said transmission means including a cam, a cam follower member engaged and moveable by the cam and connected to the resistance means, a retaining member fixed to the movement arm, and a lock member mounted on the machine and movable into and out of engagement with the retaining member for preventing movement of the movement arm about said axis when engaged with the retaining member.

2. The machine defined in claim 1 wherein said cam is fixed to the movement arm to move with the movement arm.

3. The machine defined in claim 1 wherein said movement arm includes first and second mounting portions rotatable about said axis, means including a load cell interconnecting said first and second mounting portions for measuring the load on the movement arm when the movement arm is fixed by said lock and retaining members and the back of a user engages the movement arm.

4. The machine defined in claim 3 wherein said cam and retaining member are fixed to one of said mounting portions.

5. A machine for exercising and/or testing muscles of the human body comprising in combination: a seat for receiving a user of the machine, a movement arm for engaging the user's body and having a pivot shaft being mounted for movement about an axis, resistance means for opposing movement of the movement arm in one direction about said axis when engaged by the user's body, means for immobilizing the pelvis while seated on said seat during an exercise or test, transmission means for transmitting movement between the movement arm and the resistance means, said transmission means including a drive member, and a member driven by said drive member and connected to the resistance means, and wherein said movement arm includes first and second mounting portions mounted about said pivot shaft for movement about said axis, means including a load cell interconnecting said first and second mounting portions for measuring forces applied to the movement arm and means for connecting one of said mounting portions to said resistance means, a retaining member fixed to the movement arm, and wherein said machine includes a locking member engagable with the retaining member to fix the movement arm in position.

6. The machine defined in claim 5 wherein said means for immobilizing the pelvis includes means for moving the ends of the femurs at the pelvis downwardly to secure the pelvis on the seat.

7. The machine defined in claim 6 wherein said means for immobilizing the pelvis further includes means for applying pressure against the legs at a location adjacent the knees.

8. The machine defined in claim 6 wherein said means for immobilizing the pelvis further includes means for moving the knee-ends of the femurs upwardly while the pelvis-ends of the femurs are moved downwardly.

9. A machine for exercising and/or testing muscles of the human body comprising in combination: a seat for receiving a user of the machine, a movement arm for engaging a user's body and being mounted for movement about an axis, resistance means for opposing movement of the movement arm in one direction about said axis when engaged by the body, means for immobilizing the pelvis while seated on said seat during an exercise or test and including means engagable with the front of a user's legs to apply rearward pressure on the femurs for holding the ends of the femurs at the pelvis down to secure the pelvis on the seat, and transmission means for transmitting movement between the movement arm and the resistance means, said transmission means including a drive member, and a connecting member engaged and movable by the drive member and connected to the resistance means, and wherein said means for immobilizing the pelvis includes means for applying an upwardly directed force to the front of a seated user's legs below the knee to hold the femurs down on the seat, said means for applying an upwardly directed force to the front of a seated user's legs being mounted for movement against a seated user's legs below the knees at an upward angle to the horizontal.

10. A machine defined in claim 9 wherein said drive member is a cam.

11. The machine defined in claim 9 wherein said drive member is a sprocket.

12. The machine defined in claim 9 wherein said means for immobilizing the pelvis further includes means for applying pressure against the legs at a location adjacent the knees.

13. The machine defined in claim 9 wherein said means for immobilizing the pelvis further includes means for moving the knee-ends of the femurs upwardly while the pelvis-ends of the femurs are moved downwardly.

* * * * *